US005634593A

United States Patent [19]

Jenkins

[11] Patent Number: 5,634,593

[45] Date of Patent: Jun. 3, 1997

[54] APPARATUS FOR SCANNING A STREAM OF ATOMIZED PARTICLES HAVING EXTERNALLY ADJUSTABLE AND PROGRAMMABLE GAS ROUTING

[75] Inventor: Walter N. Jenkins, Mumbles, United Kingdom

[73] Assignee: Sprayforming Developments Ltd., Innovation Centre, United Kingdom

[21] Appl. No.: 374,759

[22] PCT Filed: Aug. 17, 1993

[86] PCT No.: PCT/GB93/01742

§ 371 Date: Jan. 19, 1995

§ 102(e) Date: Jan. 19, 1995

[87] PCT Pub. No.: WO94/04279

PCT Pub. Date: Mar. 3, 1994

[30] Foreign Application Priority Data

Aug. 17, 1992 [GB] United Kingdom ..... 9217461

[51] Int. Cl.[6] ..... B05B 1/30

[52] U.S. Cl. ..... 239/69; 239/301

[58] Field of Search ..... 239/296–298, 239/300, 301, 69, 67

[56] References Cited

U.S. PATENT DOCUMENTS 4,064,295 12/1977 Singer ..... 239/297 X

FOREIGN PATENT DOCUMENTS 0127303 12/1984 European Pat. Off. .
91/12088 8/1991 WIPO .
93/00170 1/1993 WIPO .

*Primary Examiner*—Lesley D. Morris
*Attorney, Agent, or Firm*—David P. Gordon

[57] ABSTRACT

A scanning apparatus is provided for scanning a stream of atomized particles comprising a pneumatic valve through which gas can be routed to one or more nozzles to give a scanning action on the stream of atomized particles which routing is externally adjustable and externally programmable.

6 Claims, 5 Drawing Sheets

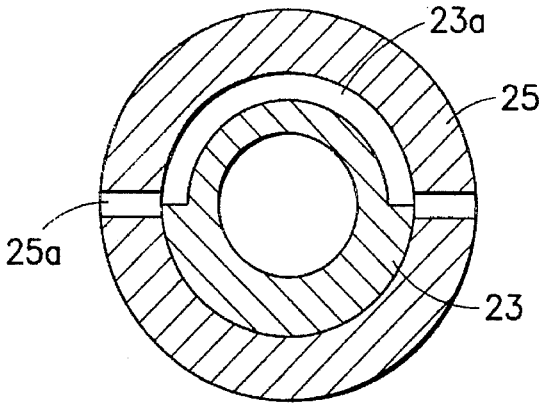
FIG. 10
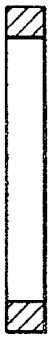
FIG. 11
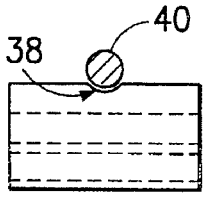
FIG. 12
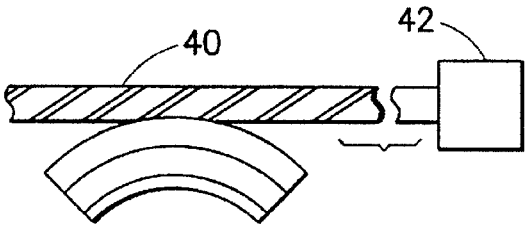
FIG. 13
FIG. 14
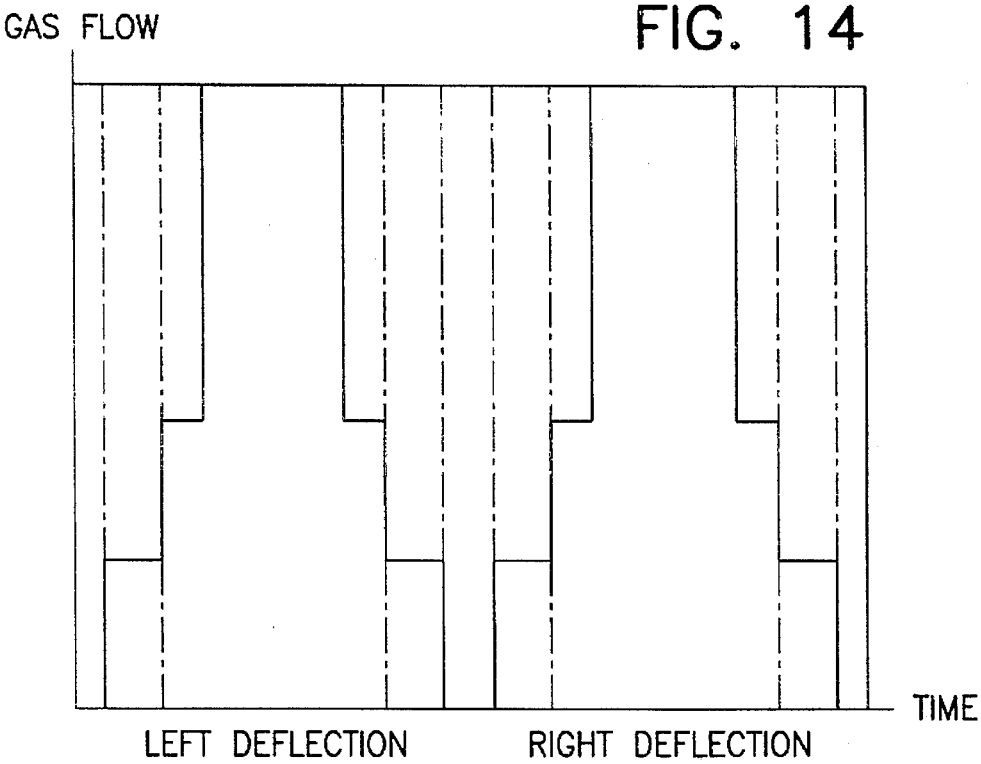

APPARATUS FOR SCANNING A STREAM OF ATOMIZED PARTICLES HAVING EXTERNALLY ADJUSTABLE AND PROGRAMMABLE GAS ROUTING

BACKGROUND OF THE INVENTION

This invention relates to the production of a spray of atomized particles and subsequently to imparting direction to the spray, and might find application in the production of either a layer or coating on a substrate, billet, tube or irregular section article.

The usual procedure is to atomize a stream of liquid by means of a high pressure gas to form a stream of atomized droplets that is directed onto a substrate or former, but it is also possible, especially with metals, to use wire or powder as the feedstock for producing a stream of droplets.

A wide range of such processes and materials have been proposed, but the process has been applied particularly advantageously to the sprayforming of metals. This process was devised in 1968 and has the capability of making a wide range of semi-finished products having improved properties. The products comprise plate, sheet and strip e.g. of high silicon steel, hollow and solid billets, tubes and rings as well as laminated products and matrix composites. In order to produce the particular shapes required it is usually necessary to move the substrate or former in an appropriate manner and at the same time to deflect the stream of atomized particles. The latter procedure is particularly important in ensuring that the process is operated with the highest efficiency with the lowest possible overspray and that the product is as near as possible to the final shape required.

We have found that the most efficient and reliable way of deflecting the stream of atomized particles is by pneumatic means i.e. using a secondary stream or streams of gas, usually inert gas, to deflect the primary atomized spray causing it to assume the required position. This procedure is herein referred to as 'scanning'. Ways of carrying out this procedure are described in GB 1455862 and GB 2129249.

Turning firstly to the external programming of pneumatic scanning atomizers embodying rotary valves for programming.

SUMMARY OF THE INVENTION

The function of pneumatic scanning atomizers generally is to vary gas flow cyclically through a set of fixed scanning nozzles facing in a direction inclined downward and towards the axis of a metal stream contained within a stream of gas, known as the atomizing gas. Deflection can occur before, during or after atomization. In practical pneumatic scanning atomizers the angle of deflection is often varied during each cycle by restricting the flow of deflecting (or scanning) gas to a degree depending on the position of the rotor of a rotary valve. A periodic function relating scanning gas flow (and consequently deflection angle) to rotor position provides a preset program. It has been found possible with our earlier designs of scanning atomizers to use preset programs, to control two variable, namely the areas of the several constrictions which successively restrict gas flow during each cycle, and the fractions of cycle time for which each of these constrictions is operative. Convenient methods for generating precise preset programs using rotary valves are described in our International Patent Application No. PCT/GB92/01128.

Two alternative arrangements of gas path have been used in our earlier devices, to both of which arrangements the present invention can be applied. FIG. 15 of the accompanying drawings shows the first of these in diagrammatic form. It is a serial arrangement in which the rotor short-circuits parts of a chain of constrictions, depending on the magnitude of the gas flow required at different parts of the cycle. FIG. 16 of the accompanying drawings shows an alternative arrangement in which the rotor selects alternative paths also depending on the gas flow required at different points in the cycle. This is called the parallel system. It is important to note that in both cases there is a unique relationship between scanning gas flow and rotor position.

It has been found possible to relate mathematically the thickness profiles formed by a pneumatic scanning atomizer with the fractions of cycle time when successive constrictions are operative, so that on-line digital control of the thickness of a spray formed deposit is possible. The control procedure, which has been experimentally verified, involves the repeated prediction, using matrix methods, of modifications to a preset program progressively to reduce errors in the thickness profile of a deposit being formed on a moving substrate.

According to this invention there is provided scanning apparatus for scanning a stream of atomized particles comprising a pneumatic valve through which gas can be routed to one or more nozzles to give a scanning action on the stream of atomized particles which routing is externally adjustable and externally programmable.

The invention also provides scanning apparatus for scanning a stream of atomized particles comprising a nozzle or set of nozzles through which gas can be fed under pressure to cause scanning of the particle stream, and externally programmable and externally adjustable control means adapted to control a pneumatic valve to adjust the supply of gas to the nozzle or set of nozzles.

If the scan involves spraying across a strip and the atomized particle stream is deflected to opposite sides of the axis of the atomized stream, it is desirable that at least the initial, central and final quantities of the distributed spray during the scan should be digitally controlled. Where the atomized particle stream is deflected to only one side of its initial axis, it is desirable that at least the first and final quantities of spray distributed should be digitally controlled.

One embodiment of the invention as applied to pneumatic scanning atomizers equipped with rotary valves will now be described in more detail with reference by way of example to the accompanying diagrammatic drawings:

BRIEF DESCRIPTION OF THE DRAWINGS

FIGS. 4 to 10 are cross-sectional views of the rotor and stator assembly of the valve on the planes 4—4 to 10—10 respectively of FIG. 2.

FIG. 11 is a cross-sectional view of a locating ring for a pair of the timing sector portions.

FIG. 12 is an elevation of one of the timing sectors.

FIG. 13 is an end view of the timing sector of FIG. 12.

FIG. 14 shows a typical gas flow/time graph.

DETAILED DESCRIPTION OF THE PREFERRED EMBODIMENTS

Figure 1:
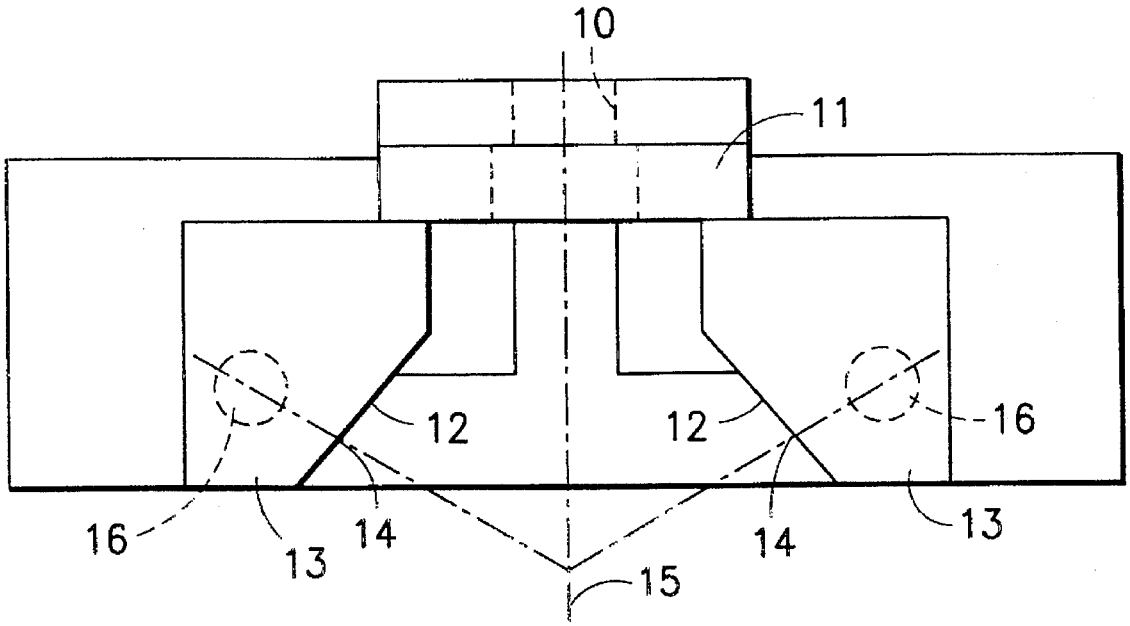
FIG. 1 is a front view of part of a pneumatic apparatus for spraying molten metal particles on to a substrate.

Referring to FIG. 1 of the drawings, the spraying apparatus shown is designed to cause a vertically descending stream of particles of molten metal to be deflected to and fro cyclically to apply a uniform coating of metal particles to a substrate in the form of a strip moving beneath the apparatus. A steady stream of molten metal is poured, for example from a crucible (not shown) through a hole 10 in an atomizer 11. In an annular rebate formed in the underside of the atomizer about the hole 10 a hollow manifold ring (not shown) is mounted in which is formed a ring of gas nozzles. The nozzles are angled downward and inward towards the axis of the stream of molten metal, and gas under pressure supplied to the manifold ring causes the resulting jets of gas from the nozzles to break the stream of metal up into particles which continue to fall substantially vertical in a stream.

The stream of particles passes downward between two horizontally spaced nozzle blocks 13 which are bridged by the atomizer 11 and on which the atomizer is mounted. The nozzle blocks 13 are respectively formed with downwardly inclined faces 12 in each of which a set of scanning nozzles (indicated generally at 14) is formed. The faces 12 are inclined downward at 45° to the horizontal and the nozzles of the two sets are arranged in horizontal lines in these faces, and are angled to converge on a predetermined point on the axis 15 of the particle stream. The nozzles in each block open from a manifold passage 16 in the block. The two manifold passages 16 are respectively connected to the two outlets 17, 18 (shown in chain lines in FIG. 2) in the casing 19 of a rotary valve 20.

Figure 2:
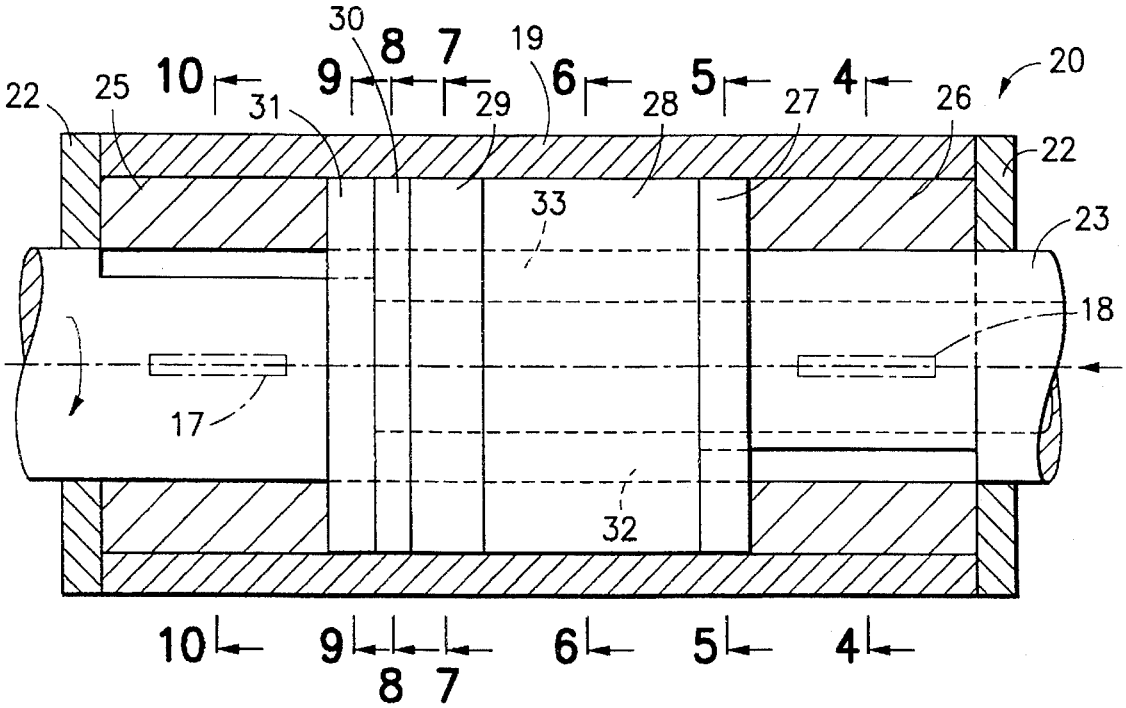
FIG. 2 shows in axial section a pneumatic valve for use in conjunction with the spraying apparatus of FIG. 1.
Figure 3:
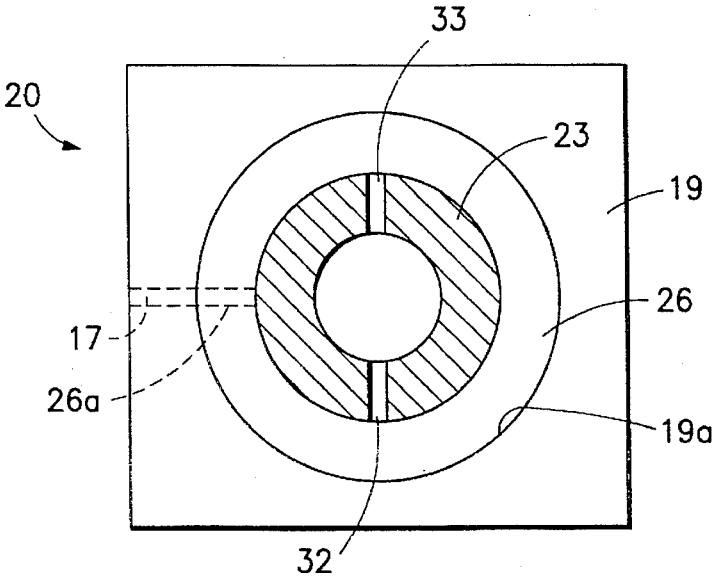
FIG. 3 is a general cross-section of the valve of FIG. 2, but omitting the elements of the stator.

Referring now to FIGS. 2 and 3, the casing 19 of the rotary valve is formed with a cylindrical bore 19*a*, opposite ends of the casing being closed by end members 22. A rotor 23 in the form of a shaft extends through the casing, seals (not shown) being provided where the shaft extends through the end members 22. The rotor is hollow along part of its length, and gas under pressure is fed into the hollow interior of the shaft from the right hand end as indicated in FIG. 2.

Figure 9:
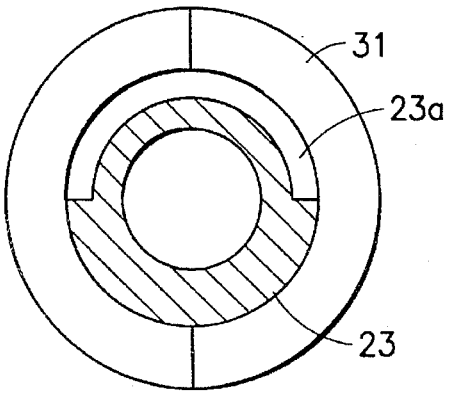
Figure 15:
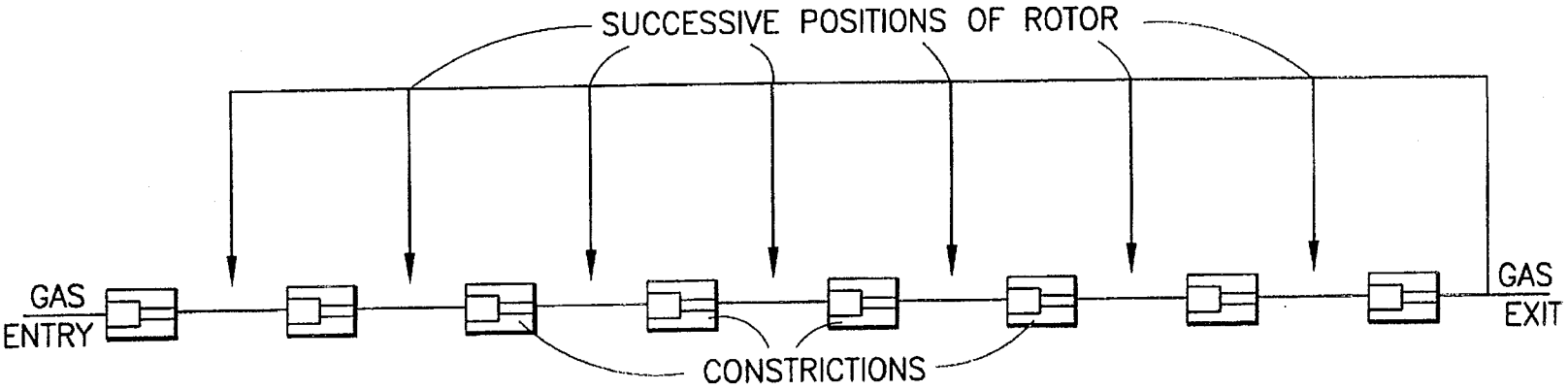
FIG. 15 PRIOR ART
FIG. 15 shows a schematic of a prior art serial system pneumatic scanning atomizer.
Figure 16:
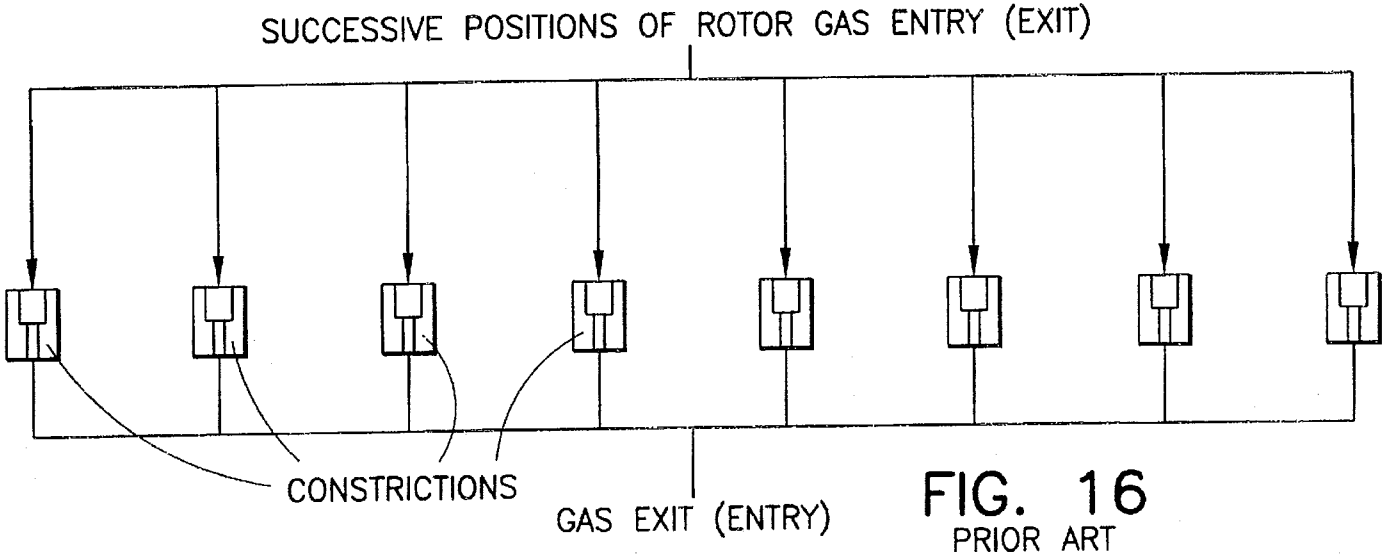
FIG. 16 PRIOR ART
FIG. 16 shows a schematic of a prior art parallel system pneumatic scanning atomizer.

The axially central part of the bore 19*a* is occupied by a first spacer ring 27, three timing sectors 28, 29, 30 respectively and a second half-annular spacer 31. Two diametrically opposite slots 32, 33 extend radially through the rotor in the part of the rotor between the axially inner ends of the two spacers 27, 31. The spacers 27 and 31 are of half-annular form and are identical to each other. The spacers are both disposed as shown in FIGS. 5 and 9.

The two ends of the bore 19*a* between the spacers and the two end members 22 are occupied by identical annular liners 25, 26 which form a seal with both the outer diameter of the rotor 23 and the bore 19*a*. The two liners have radially extending slots 25*a*, 26*a* through them which communicate with the outlets 17, 18 respectively. Semi-cylindrical recesses 23*a*, 23*b* are respectively formed in the outer surface of the rotor where it extends through the liners 25, 26 and the adjoining spacers 31, 27, and as indicated in FIGS. 4 and 10 the recesses are at diametrically opposite sides of the rotor.

Figure 6:
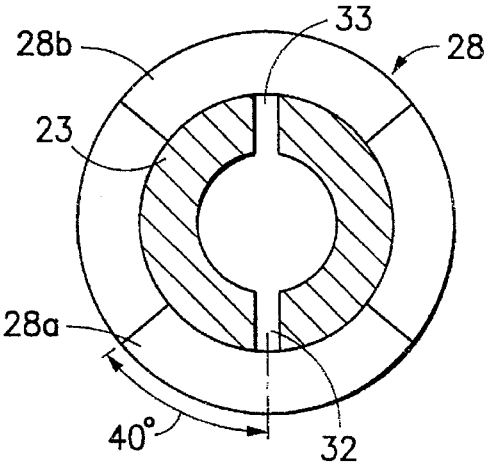
Figure 7:
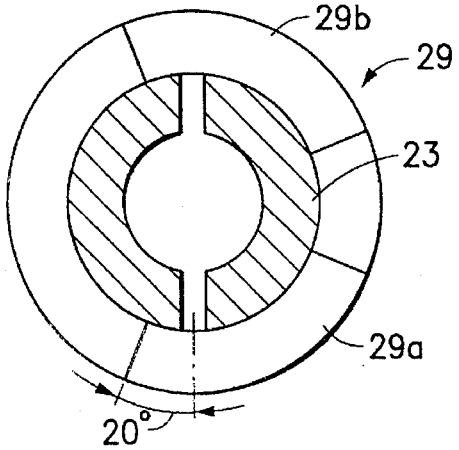
Figure 8:
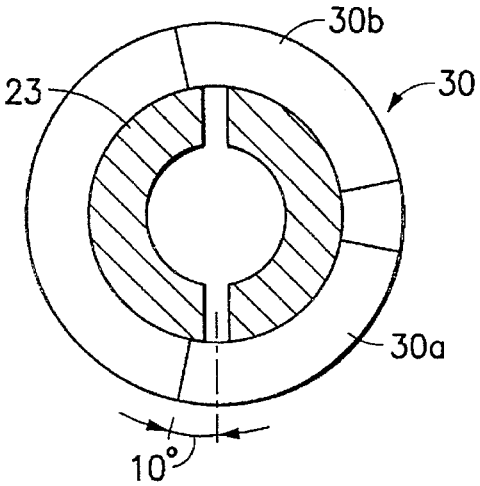

Each of the timing sectors 28, 29, 30 is constituted by two circumferentially spaced sector portions. Thus sector 28 comprises portions 28*a*, 28*b* as shown in FIG. 6, sector 29 comprises portions 29*a*, 29*b* as shown in FIG. 7, and sector 30 comprises portions 30*a*, 30*b* as shown in FIG. 8. Each sector portion seals against both the rotor and the bore 19*a*.

Figure 4:
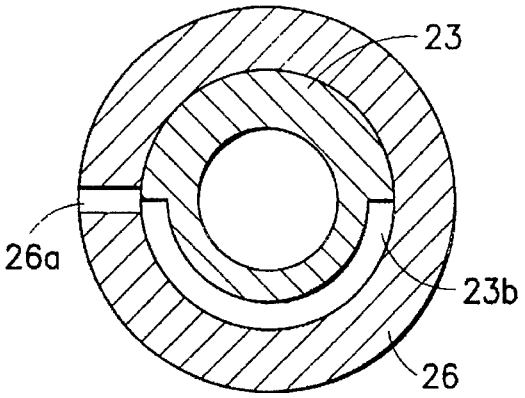
Figure 5:
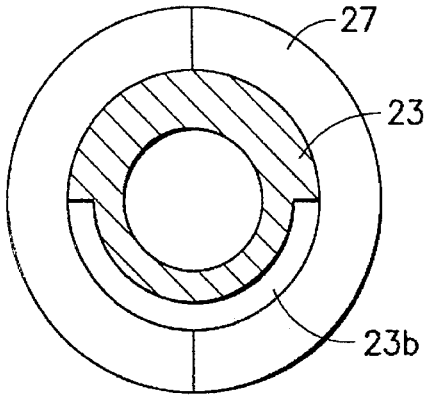

In the positions of the timing sectors 28, 29, 30 shown in FIGS. 6, 7 and 8 all gas flow from the interior of the rotor 23 through the two radial slots 32, 33 is obstructed by the timing sectors, but when the rotor rotates through 10° clockwise (see FIG. 8) the lower slot 32 rotates beyond the trailing end of the sector portion 30*a* of timing sector 30 and can flow axially between the portions 29*a*, 29*b* of sector 29 and between the portions 28*a*, 28*b* of sector 28, and into the groove 23*b* shown in FIGS. 5 and 4 which leads to the slot 26*a* and outlet 18. The flow to the right hand set of nozzles 14 during this time is determined by and is proportional to the width of the slot 32 in the rotor multiplied by the axial length of the timing sector 30.

Continuing rotation of the rotor 23 next moves the lower slot 32 past the trailing edge of the lower portion 29*a* of the timing sector 29 (see FIG. 7), so that there is a digital increase in the amount of gas which can flow first into the part annular space between the two portions 29*a*, 29*b* of the timing sector 29 and thence axially between the two portions 28*a*, 28*b* of the timing sector 28 and thence into the slot 26*a*. The resulting increase in the quantity of gas flowing to the right hand set of nozzles is determined by and is proportional to the width of the slot 32 multiplied by the axial length of the timing sector 29.

Continuing rotation of the rotor 23 through a further 20° then causes the slot to pass the trailing end of the lower portion 28*a* of the timing sector 28 (see FIG. 6), and this causes a further digital increase in the amount of gas flowing through slot 26*a* to the right hand set of nozzles 14. Continuing rotation of the rotor then moves the slot 32 successively past the leading ends of the opposite portions 28*b*, 29*b*, 30*b* of the timing sectors so that the amount of gas supplied through the slot 26*a* to the right hand set of nozzles falls stepwise to zero in the same manner as it increased.

Although during the half-revolution of the rotor just described the opposite slot 33 in the rotor is unblocked by edges of the portions 30*b*, 29*b*, 28*b* of the timing sectors, passage of the gas to the opposite liner 26 is obstructed by the spacers 27, 31.

When the slot 32 in the rotor has moved through 180° from its starting position, flow through that slot is obstructed by the timing sector portions and by the spacers 27, 31 but slot 33 recommences the gas flow cycle, but now the recess 23*a* is blanked off by spacer 27 and recess 23*b* comes into register with the spacer between the timing sector portions and directs the gas flow to slot 25*a* and thence to the left hand set of nozzles.

The two portions of each timing sector 28, 29, 30 are each in the form shown in FIGS. 12 and 13, and have a part circular recess 34 in at least one end face into which a locating ring 35 shown in FIG. 11 fits. The two locating rings are thus supported by the ring. If desired a similar recess may be provided at the other axial ends of the two sector portions and a second support ring fitted into these. The two spacer rings and the intervening timing sectors which jointly constitute the stator are suitably located in abutment with each other but not sufficiently tightly to prevent relative rotation of the timing sectors.

Referring to FIGS. 11 and 12, in order to provide for adjustment of the times at which flow from the slots into the part annular spaces between the two portions of each timing sector, each timing sector has extending circumferentially along its outer periphery a groove (38) in which are formed angled teeth which are engaged by a worm gear secured on a shaft (40) extending tangentially of the portion of the timing sector. These shafts are driven by respective displacement means, for example, stepping motors (43), and it will be understood that the two portions of each timing sector are driven through corresponding angles but in opposite directions to maintain the symmetry of the gas flow The stepping-motors may be manually controlled or computer controlled.

The gas flow at any time to one or other of the sets of nozzles determines the degree of deflection of the atomized particle stream by that set of nozzles.

It will be understood that the largest timing sector 28 may be of any axial length so long as the constriction area is greater than the total area of each set of gas nozzles FIG. 14 shows a typical gas flow/time graph where atomized aluminium alloy is being sprayed on to a strip moving underneath the spraying apparatus at a uniform speed.

It will thus be understood that over a first time interval there is zero flow to either of the sets of deflecting nozzles, followed by a second time interval during which deflecting gas is supplied at a constant rate to the nozzles which deflect the atomized metal to the left. At the end of the second time interval, there is a further sudden increase in the amount of gas supplied to the same set of nozzles for a third time interval, after which the flow of the set of nozzles is reduced stepwise in the same way as it increased. During a further time interval there is no gas supply to either set of nozzles and then the pattern of supply is repeated to the nozzles which deflect the gas stream to the right. The pattern is repeated, moving the spray to and fro across the moving strip.

We have found that we can predict mathematically, using metrix methods, the effect, across the width of the spraying pattern, of successive increments and reductions of the time for which the gas flows are at the predetermined levels determined by the axial lengths of the timing sectors, so that if we monitor the thickness of the sprayed coating at predetermined locations across the width of the strip, we can use the measured thicknesses in conjunction with a computer program to adjust the positions of the timing sector portions stepwise to achieve an even thickness of the sprayed material across the width of the substrate. The programmed thicknesses need not be the same across the width of the strip.

If desired, for example where a billet is being continuously cast by metal spraying techniques, the spray may be deflected to only one side of the axis of the vertical particle stream.

By such means as are described above the distribution of droplets in the atomized stream might be altered during deposition, by for example erosion, or partial blockage of the dispensing nozzle. The invention enables compensatory adjustments to be made during the run or between runs to restore the required shape of the product. In other circumstances it might be required to change the width of a strip deposit between successive coils, in which a rapid change of preset program for the new width would be possible in a setting up procedure. There are other potential advantages in having an externally programmable scanning operation, including the ability to change, modify and control by means of computer software.

Generally speaking, it is rather more effective to apply the invention to pneumatic scanning atomizers of the type described in the patents referred to above, because of their robustness and potential for high speed operation, but it is also possible to envisage ways to control scanning atomizers of the type which operate using a mechanical as distinct from a pneumatic scanning principle, and also to control arc spray guns, plasma spray guns, HVOF guns etc., using devices described above.

Although rotary valves have proved to have many advantages over other types of programmable valve, it is possible to apply the invention to reciprocating gas valves. Some such valves, e.g. slide piston types can be designed with shaped orifices by means of which gas flow can be made a function of, e.g. proportional to the displacement of the actuating piston. Another example is the poppet valve. The means for programming gas flow in such devices would then be a cyclical electronic signal applied to a displacement transducer such as a stepper motor or a high power moving coil ('loudspeaker') movement. In a particular system, the wave form of the cyclical electronic signal would be uniquely related to the thickness profile it produces, the magnitude of the harmonics in the signal determining the distribution of deposit across the width of a moving substrate. Such a control signal could be obtained for example from a relatively conventional electronic signal generator and amplification system, with a visual display linked to a conventional oscilloscope. It is evident that similar methods could be applied to program externally the oscillation of the moving parts in mechanical types of scanning atomizer.

I claim:

1. Apparatus for scanning, in a predetermined manner, a stream of atomized particles directed along an axis, said apparatus comprising:

a) at least one gas nozzle arranged to direct a scanning gas toward the axis; and b) a rotatable pneumatic valve having a rotor and a routing means arranged to route an amount of said scanning gas through said valve to said at least one gas nozzle to thereby impart a scanning action to the stream of atomized particles, wherein said amount of scanning gas routed through said valve to said at least one nozzle is arranged to vary cyclically in a pre-determined manner with rotation of said rotor, said routing means being externally adjustable and externally programmable to be displaced between a first routing configuration and a second routing configuration in order to alter said predetermined cyclical variation of gas routed through said valve.

2. An apparatus for scanning according to claim 1, further comprising:

c) electronic data control means arranged to operate through a displacement means to effect adjustment of said routing means.

3. An apparatus for scanning according to claim 2, wherein:

said electronic data control means includes means for adjusting stepwise the amount of gas routed through said valve.

4. An apparatus for scanning according to claim 1, wherein:

said pneumatic valve includes a stator having a pair of angularly spaced timing elements arranged to operate respectively to open and close off the supply of gas to said at least one nozzle through a port in a rotary member, and means for adjusting the rotational positions of said timing elements relative to said port.

5. An apparatus for scanning according to claim 4, wherein:

said means for adjusting said rotational positions of said timing elements are arranged such that said timing elements remain equiangularly disposed about said port.

6. An apparatus for scanning according to claim 4, wherein:

said means for adjusting said rotational positions of said timing elements include respective stepping motors forming part of said control means.

* * * * *